US005836049A

United States Patent [19]

Chiang

[11] Patent Number: 5,836,049

[45] Date of Patent: Nov. 17, 1998

[54] DOOR STOP

[76] Inventor: Mao Sung Chiang, No. 76, Hsin-1 Road, Sec. 2, Taipei, Taiwan

[21] Appl. No.: 934,325

[22] Filed: Sep. 19, 1997

[51] Int. Cl.[6] ..... E05F 5/02

[52] U.S. Cl. ..... 16/82; 16/86 A; 292/DIG. 15; 292/251.5

[58] Field of Search ..... 16/82, 85, 86 A, 16/86 R, 86 B, DIG. 17; 292/DIG. 15, 341.12, 251.5, 340, 341.15

[56] References Cited

U.S. PATENT DOCUMENTS

| | | | |
|---|---|---|---|
| D. 248,212 | 6/1978 | Miller, Jr. | 292/DIG. 15 |
| 913,748 | 3/1909 | Mefford | 292/DIG. 15 |
| 2,153,232 | 4/1939 | Beck et al. | 292/DIG. 15 |
| 2,311,278 | 2/1943 | Johnson | 16/86 R |
| 2,519,435 | 8/1950 | Byrd, Jr. | 16/82 |
| 2,558,614 | 6/1951 | Jewell, Jr. | 292/DIG. 15 |
| 3,010,142 | 11/1961 | Ahlquist | 16/86 R |
| 3,701,557 | 10/1972 | Centofante | 292/251.5 |
| 5,010,622 | 4/1991 | Morita | 16/82 |

*Primary Examiner*—Chuck Mah
*Attorney, Agent, or Firm*—Pro-Techtor International Services

[57] ABSTRACT

A door stop including a holder unit fixedly fastened to the floor to hold a magnet, and a strap fixedly fastened to the door to hold an iron plate for securing to the magnet of the holder unit by a magnetic force of attraction to hold the door in an open position, and a retainer loop coupled to the strap by a slip joint and adapted for hanging on a T-rod of the holder unit to stop the door from escaping out of the open position.

7 Claims, 4 Drawing Sheets

DOOR STOP

BACKGROUND OF THE INVENTION

The present invention relates to a door stop, and more particularly to such a door stop which provides a secondary stop means to stop the door in an open position when the door is opened to close the door stop.

Regular door stops commonly use a magnetic force of attraction to retain the door in an open position. However, using a magnetic force of attraction to retain the door in an open position has drawbacks. When the door is opened to close the door stop, a big noise will be produced. Further, when a heavy wind force is acted against the door toward to surpass the magnetic force of attraction, the door will be forced away from the open position. There are known other types of door stops which use male and female fastening means for securing the door in an open position. However, these door stops produce a big noise when closed. Further, much effort should be employed to the door when to open these door stops.

SUMMARY OF THE INVENTION

It is one object of the present invention to provide a door stop which provides a secondary stop means to stop the door in an open position when the door is opened to close the door stop. It is another object of the present invention to provide a door stop which produces little noise when it is closed to secure the door in an open position. According to one aspect of the present invention, the door stop comprises a holder unit fixedly fastened to the floor to hold a magnet, and a strap fixedly fastened to the door to hold an iron plate for securing to the magnet of the holder unit by a magnetic force of attraction to hold the door in an open position, and a retainer loop coupled to the strap by a slip joint and adapted for hanging on a T-rod of the holder unit to stop the door from escaping out of the open position. According to another aspect of the present invention, the holder unit comprises a cushion block mounted around the magnet which lessens shocks.

DETAILED DESCRIPTION OF THE PREFERRED EMBODIMENT

Figure 1:
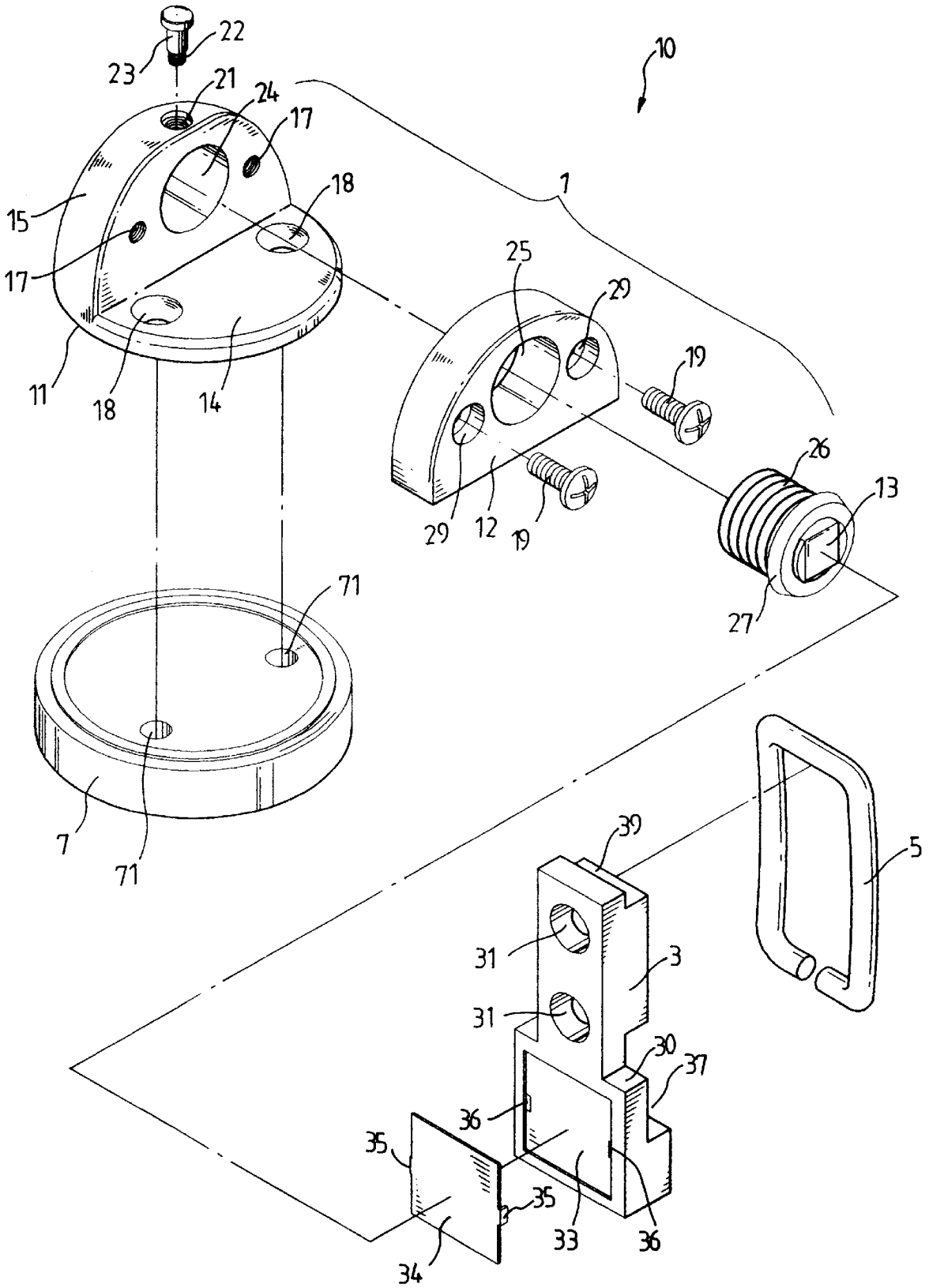
FIG. 1 is an exploded view of a door stop according to the present invention.
Figure 2:
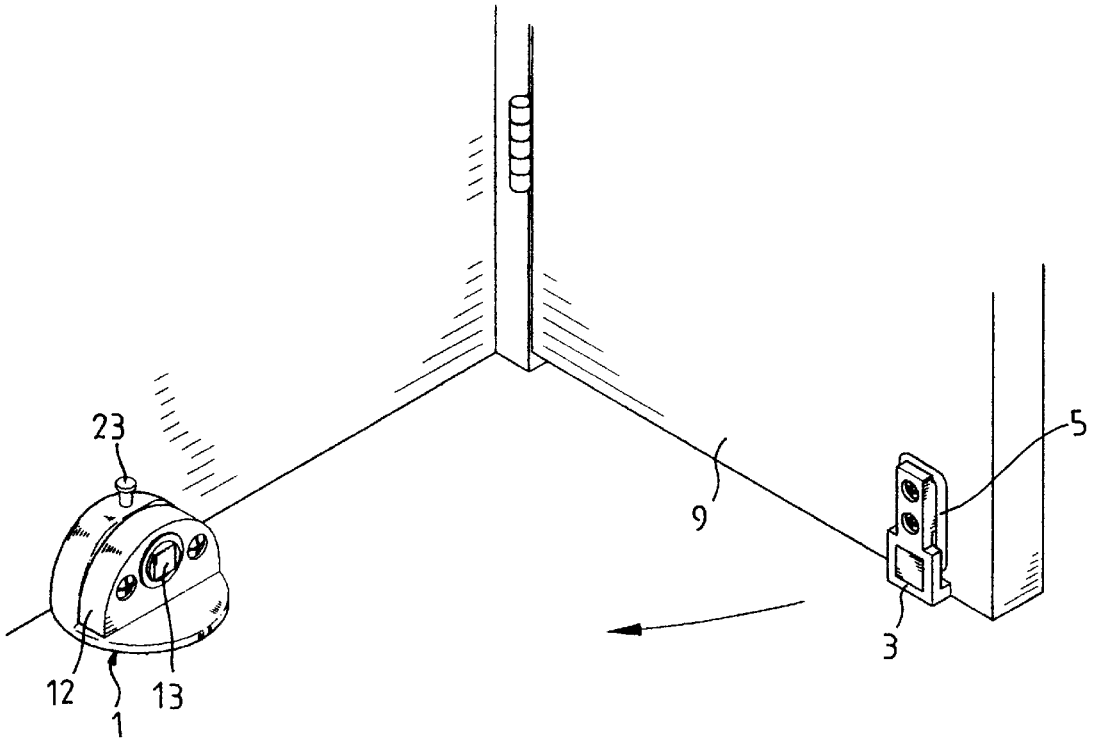
FIG. 2 is an applied view of the present invention, showing the door stop installed in a floor and a door.

Referring to FIGS. 1 and 2, a door stop 10 is generally comprised of a holder unit 1, a strap 3, and a retainer loop 5. The holder unit 1 is fixedly fastened to the floor. The strap 3 is fixedly fastened to the door, referenced by 9. The retainer loop 5 is pivoted to the strap 3. When the door 9 is opened, the retainer loop 5 is fastened to the holder unit 1 to secure the door 9 in the open position.

Figure 3:
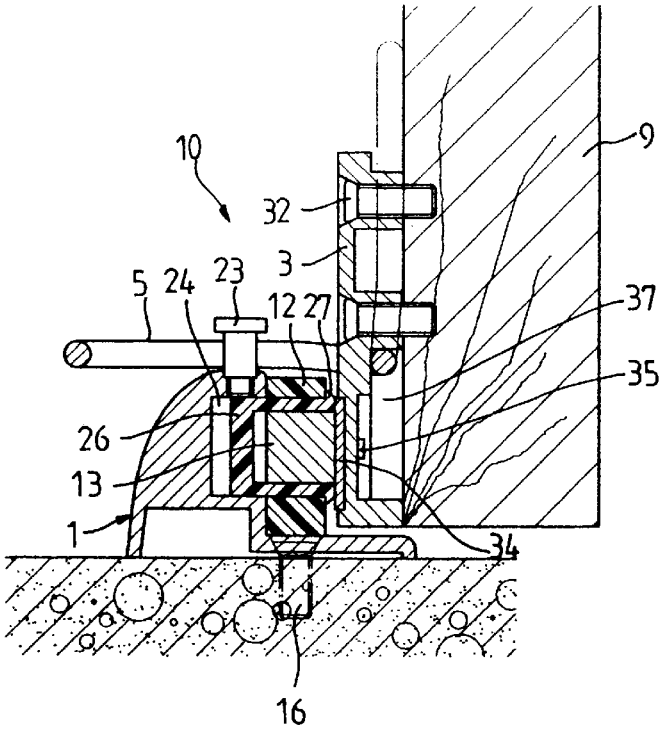
FIG. 3 is a sectional view of the present invention, showing the door stop closed.

Referring to FIG. 3 and FIGS. 1 and 2 again, the holder unit 1 comprises a mounting base 11, a cushion block 12, a socket 26, and a magnet 13. The mounting base 11 comprises a horizontal flat bottom block 14, and a vertical stop block 15 raised from the horizontal flat bottom block 14. The horizontal flat bottom block 14 has two mounting holes 18 in which two screws 16 are installed to fixedly secure the mounting base 11 to the floor (see FIG. 3). The vertical stop block 15 comprises a vertical screw hole 21 at its top side, a T-rod 23 having a threaded bottom end 22 threaded into the vertical screw hole 21, a horizontal socket hole 24 at its flat front side adapted for receiving the socket 26, and two horizontal screw holes 17 equally spaced from the horizontal socket hole 24 at two opposite sides. The cushion block 12 fits over the flat front side of the vertical stop block 15 of the mounting base 11, having two countersunk holes 29 respectively fastened to the horizontal screw holes 27 of the vertical stop block 15 of the mounting base 11 by a respective screw 19, and a through hole 25 disposed in alignment with the horizontal socket hole 24 of the vertical stop block 15 of the mounting base 11. The socket 26 is tightly fitted into the through hole 25 of the cushion block 12 and the horizontal socket hole 24 of the vertical stop block 15 of the mounting base 11, having an outward flange 27 raised around the periphery of its front end and stopped outside the through hole 25 of the cushion block 12. The magnet 13 is fixedly mounted within the socket 26, and partially projects out of the front end of the socket 26. In order to increase the friction force between the periphery of the through hole 25 of the cushion block 12 and the periphery of the socket 26, the periphery of the socket 26 is preferably threaded. The vertical screw hole 21 can be made in communication with the horizontal socket hole 24, so that the threaded bottom end 22 of the T-rod 23 can be forced into engagement with the threaded periphery of the socket 26 to hold down the socket 26 in the horizontal socket hole 24 of the vertical stop block 15 of the mounting base 11. The strap 3 is a flat block having a narrow upper part and a broad lower part and two shoulders bilaterally defined between the narrow upper part and the broad lower part. The upper part of the strap 3 has two vertically spaced countersunk holes 31 respectively fastened to the door 9 by a respective screw 32. The lower part of the strap 3 has a front recess 33 and two locating holes 36 bilaterally disposed within the front recess 33. An iron plate 34 is mounted within the front recess 33 in a flush manner, having two backward mounting lugs 35 respectively fitted into the locating holes 36 of the strap 3. The strap 3 further comprises a back open chamber 37 at its back side in the middle, and a transverse locating groove 39 at the top side of its narrow upper part. The retainer loop 5 is hung on the strap 3. The width of the open space defined within the retainer loop 5 is greater than the width of the narrow upper part of the strap but shorter than the width of the broad lower part. When the strap 3 is fixedly fastened to the door 9, the retainer loop 5 is coupled to the back open chamber 37 and retained to the strap 3 by a slip joint. When not in use, the free end of the retainer loop 5 is turned upwards and rested on the transverse locating groove 39, and therefore the retainer loop 5 is retained in a vertical position (see FIG. 2).

Referring to FIG. 3 again, when the door 9 is opened and moved to the holder unit 1, the iron plate 34 is attracted by the magnet 13, and therefore the door 9 is retained in the open position. When the strap 3 is secured to the holder unit 1 by a magnetic force of attraction, the retainer loop 5 can then be pulled upwards from the transverse locating groove 39 of the strap 3, and then turned outwards from the vertical position shown in FIG. 2 to a horizontal position supported on the shoulders of the strap 3 and rested on the vertical stop block 15 of the holder unit 1 around the T-rod 23. If the door 9 is forced away from the holder unit 1 by wind force which surpasses the magnetic force of attraction, the retainer loop 5 will be pulled into engagement with the T-rod 23 to stop the door 9 from escaping away from the constraint of the holder unit 1.

Figure 4:
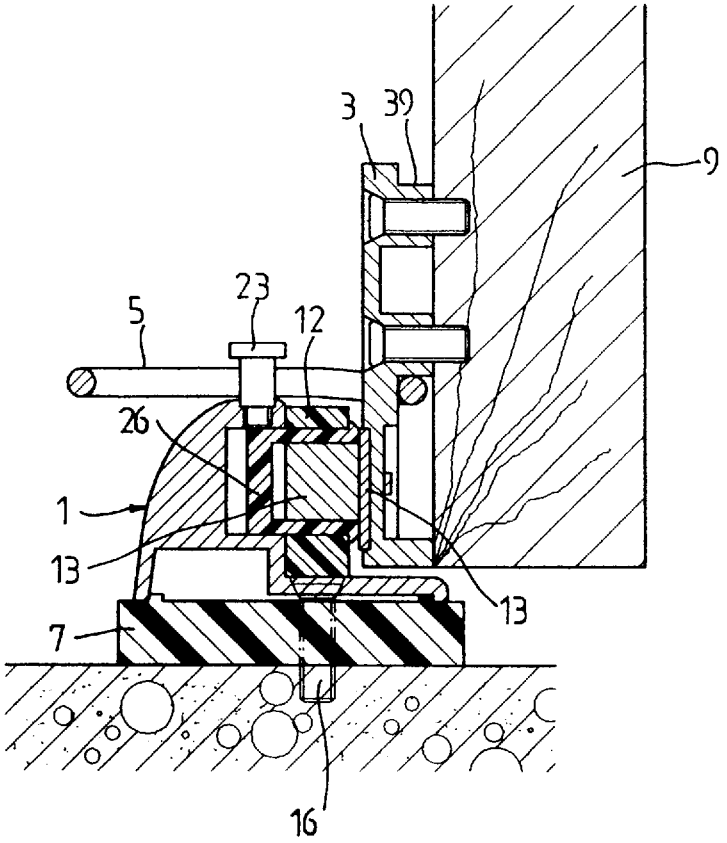
FIG. 4 is similar to FIG. 3 but showing a packing block mounted between the floor and the mounting base of the holder unit.

Referring to FIG. 4 and FIG. 1 again, a packing block 7 may be mounted between the floor and the mounting base 11 of the holder unit 1 to support the holder unit 1. The packing block 7 has two through holes 71 respectively aligned with the mounting holes 18 of the horizontal bottom block 14 of the holder unit 1 for receiving the screws 16. The packing block 7 is designed to lift the elevation of the holder unit 1, for permitting the magnet 13 of the holder unit 1 to be maintained at the same elevation of the iron plate 34 of the strap 3.

Figure 5:
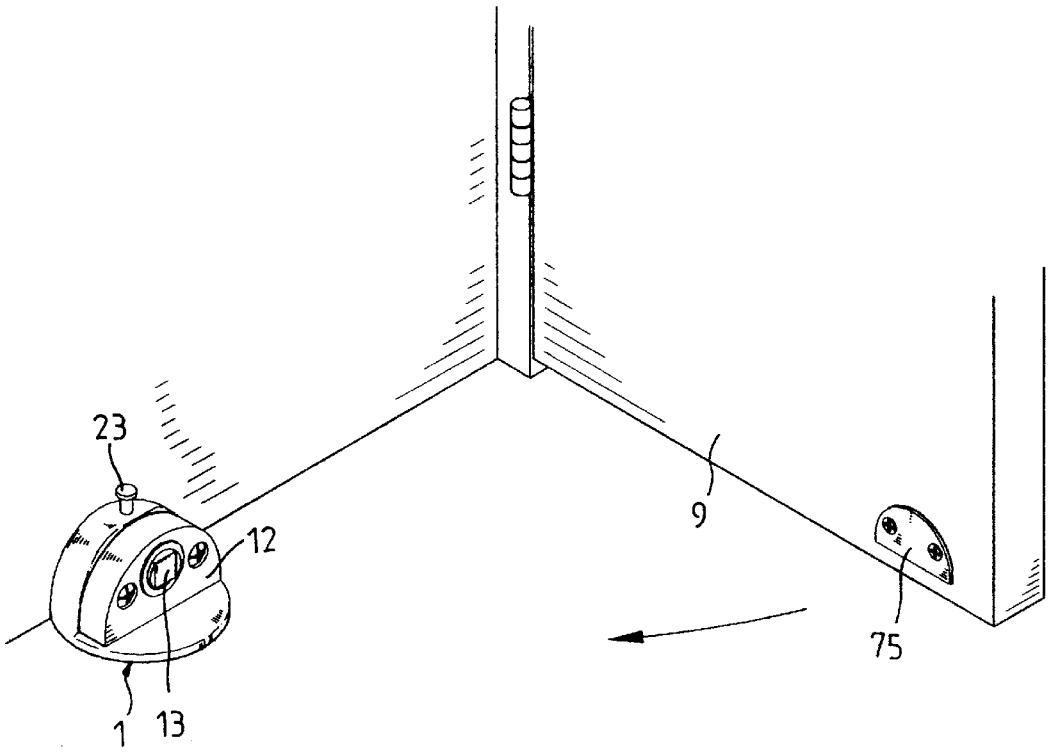
FIG. 5 shows an alternate form of the present invention.
Figure 6:
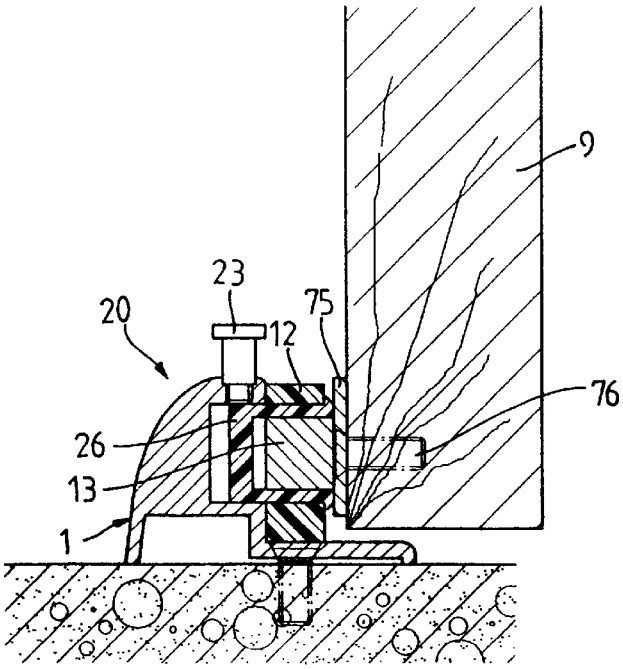
FIG. 6 is a sectional view of the alternate form of FIG. 5, showing the door opened, the iron plate secured to the magnet of the holder unit.

Referring to FIGS. 5 and 6, as an alternate form of the present invention, the door stop can be simply comprised of a holder unit 1 fixedly fastened to the floor, and an iron plate 75 fixedly fastened to the door 9 by screws 76 to act with the magnet 13 of the holder unit 1.

It is to be understood that like reference signs indicate identical or similar parts through out the drawings, and the drawings are designed for purposes of illustration only and are not intended as a definition of the limits and scope of the invention disclosed.

What the invention claimed is:

1. A door stop comprising:

a holder unit adapted to be fixedly fastened to a floor, said holder unit comprising a mounting base, a cushion block, a socket, a T-rod and a magnet, said mounting base comprising a horizontal flat bottom block adapted to be fixedly fastened to the floor by screws and a vertical stop block raised from a stop side of said horizontal flat bottom block, said vertical stop block having a horizontal socket hole, said T-rod being fastened to a top side of said vertical stop block, said cushion block being fixedly fastened to a front side of said vertical stop block of said mounting base and having a through hole disposed in alignment with the socket hole of said vertical stop block of said mounting base, said socket being tightly fitted into the through hole of said cushion block and the socket hole of said vertical stop block of said mounting base, said magnet being fixedly mounted within said socket and having a front end exposed outside said cushion block;

a strap, adapted to be fixedly fastened to a door, said strap being secured to said magnet of said holder unit by a magnetic force of attraction to hold the door in an open position when the door is opened, said strap comprising a narrow upper part, a broad lower part, two shoulders bilaterally defined between said narrow upper part and said broad lower part, a transverse locating groove at a top side of said narrow upper part, a front recess at a front side of said broad lower part, and an iron plate fixedly fastened to said front recess in a flush manner and adapted to act with the magnet of said holder unit;

a retainer loop coupled to the narrow upper part of said strap by a slip joint and set between a vertical position hung on the transverse locating groove of said strap and a horizontal position supported on the shoulders of said strap, said retainer loop being hung on the T-rod of said holder unit when it is set in the horizontal position and the door is opened and retained in the open position.

2. The door stop of claim 1, wherein said vertical stop block of said mounting base comprises a vertical screw hole at a top side thereof; said T-rod has a threaded bottom end threaded into the vertical screw hole of said vertical stop block of said mounting base of said holder unit.

3. The door stop of claim 2, wherein said vertical screw hole of said vertical stop block communicates with the socket hole of said vertical stop block.

4. The door stop of claim 1, wherein said socket has a threaded outside wall.

5. The door stop of claim 4, wherein said socket has an outward flange at one side stopped outside the through hole of said cushion block.

6. The door stop of claim 1, wherein said strap comprises two locating holes bilaterally disposed within the front recess of its broad lower part; said iron plate has two backward locating lugs respectively fastened to the locating holes of the broad lower part of said strap.

7. The door stop of claim 1 further comprising a packing block adapted to be fixedly fastened between the floor and said horizontal flat bottom block of said mounting base.

* * * * *